United States Patent [19]

Rich

[11] 4,403,820

[45] Sep. 13, 1983

[54] CONNECTOR FOR TERMINATING UNDERCARPET SIGNAL TRANSMISSION CABLE

[75] Inventor: Donald S. Rich, Long Valley, N.J.

[73] Assignee: Thomas & Betts Corporation, Raritan, N.J.

[21] Appl. No.: 213,310

[22] Filed: Dec. 5, 1980

[51] Int. Cl.[3] ..... H01R 13/38

[52] U.S. Cl. ..... 339/97 R; 339/177 R

[58] Field of Search ..... 339/97 R, 97 P, 98, 339/99 R, 176 MF, 177 R, 177 E

[56] References Cited

U.S. PATENT DOCUMENTS

| | | | |
|---|---|---|---|
| 2,476,429 | 7/1949 | Paules | 173/269 |
| 3,058,088 | 10/1962 | Miller | 339/97 |
| 3,543,222 | 11/1970 | Rheinfelder | 339/99 R |
| 3,691,509 | 9/1972 | Krol | 339/14 |
| 3,768,067 | 10/1973 | Rault | 339/99 |
| 3,813,634 | 5/1974 | Wigby et al. | 339/17 |
| 3,824,528 | 7/1974 | Esser | 339/97 |
| 3,864,011 | 2/1975 | Huber | 339/103 |
| 3,874,762 | 4/1975 | Shott et al. | 339/99 R X |
| 3,963,319 | 6/1976 | Schumacher et al. | 339/176 |
| 4,153,326 | 5/1979 | Frantz et al. | 339/99 R |

*Primary Examiner*—Joseph H. McGlynn

*Attorney, Agent, or Firm*—Robert M. Rodrick; Salvatore J. Abbruzzese; Jesse Woldman

[57] ABSTRACT

An electrical connector for terminating a coaxial cable assembly has joinable housings, one housing providing a passage for cable assembly receipt and a second passage for receiving an insulation-piercing contact, the other housing supporting an insulating-piercing contact for entry into the first housing to electrically engage the central conductor of the coaxial cable assembly. Housing interlock means are provided for enabling registry of the contact and central conductor and for imposing strain-relief force upon the cable assembly at the same time.

30 Claims, 14 Drawing Figures

CONNECTOR FOR TERMINATING UNDERCARPET SIGNAL TRANSMISSION CABLE

FIELD OF THE INVENTION

This invention relates to electrical connectors and pertains particularly to connectors for termination of coaxial cable assemblies.

BACKGROUND OF THE INVENTION

The recent commercialization of the flat conductor cable (FCC) system for distribution of electrical power beneath carpet tiles has given rise to the need for companion systems for transmission of signals as between digital consoles and accessory data processing equipment. In a companion patent application, Ser. No. 06/213,311, filed on even date herewith and commonly assigned, applicant discloses a type of coaxial cable assembly suited for the undercarpet environment and comprised of a resilient protective body releasably enclosing a coaxial cable subassembly having a center conductor, annular electrical insulation thereabout, a drain wire and an outer conductive sheath. The existence of such cable assembly gives rise to the further need for ready termination thereof, i.e., the expeditious making of electrical connections to the center conductor and drain wire thereof.

Particularly desired aspects of ready termination, from applicant's viewpoint, are insulation-piercing connection to the center conductor, gas-tight connection to both the center conductor and the drain wire, and strain relief for the connections, by application of retentive force to the cable assembly spacedly of the connection locations. Preferably, all such ready termination aspects should be provided jointly in the course of cable assembly termination. While prior art efforts are known in which coaxial cable is terminated through insulation-piercing, no connector structure has been proposed which provides for the occurrence of applicant's desired connector performance aspects.

SUMMARY OF THE INVENTION

The present invention has as its object the provision of an efficient electrical connector for termination of undercarpet data transmission cable assemblies.

A more particular object of the invention is the provision of an electrical connector for insulation-piercing termination of the center conductor of coaxial cable assemblies and gas-tight connection to both such center conductor and the assembly drain wire.

In attaining the foregoing and other objects, the invention provides an electrical connector comprised of first and second joinable housings, the first housing defining an inlet passage for receiving the cable assembly and a contact-receiving passage extending exteriorly of the first housing and across the cable-receiving passage. The second housing has exterior configuration for interfitting with the first housing and presents an insulation-piercing contact thereto, for entry into such contact-receiving passage. Housing interlock means provides for registry of the contact and contact-receiving passage and is operable to force the contact into electrical engagement with the center conductor. In the particularly preferred embodiment, the housing interlock means provides joint gas-tight connection to both the center conductor and the drain wire, a passage being provided in the first housing for routing of the drain wire across the contact-receiving passage. Further, in such preferred embodiment, operation of the housing interlock means effects application of a strain-relief force to the body of the cable assembly, all features being derived from a single mechanical input to the housing interlock means.

The foregoing and other features of the invention will be further evident from the following detailed description of preferred embodiments of electrical connectors in accordance with the invention and from the drawings thereof wherein like reference numerals identify like parts throughout.

DESCRIPTION OF THE PREFERRED EMBODIMENTS

Figure 1:
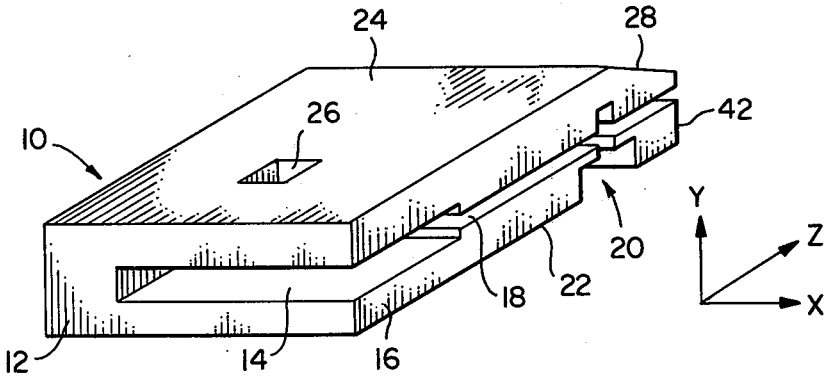
FIG. 1 is a perspective view of an upper connector housing in accordance with the invention.

Referring to FIG. 1, an upper connector housing 10 has a front wall 12 defining an inlet passage 14 for receiving a coaxial cable assembly. Side wall 16 defines a passage 18 for guidingly receiving the drain wire of such coaxial cable assembly. For reference purposes, elongate housing 10 has depth or longitudinal expanse along axis Z, width or lateral expanse along axis X and height or transverse expanse along axis Y. Passage 18 will be seen as being open fully along the Z-axis and hence accessible exteriorly of side wall 16 of upper connector housing 10. Cable inlet passage 14 is likewise open along an extent of side wall 16. At a given depth along side wall 16, opening 20 is formed in base exterior surface 22 to define a contact-receiving passage in upper connector housing 10. Ceiling 24 of housing 10 defines an opening 26, for purposes discussed below, such opening 26 extending transversely through housing 10 to communicate with cable inlet passage 14.

Referring jointly now to FIG. 1 and FIGS. 3–6, a rearward tapered wall 28 extends depthwise from ceiling 24 and includes an opening 30 in general funnel configuration tapering to a drain wire retention slot. Depthwise inwardly, inlet passage 14 is continuous with passage 32, intended for receipt of the insulated center conductor of the coaxial cable assembly. Passage 14 is also continuous at wall 36 with drain wire passage 34, transversely in stepped-down relation with passage 18. Inlet passage 14 is further bounded by inner side wall 38 of housing 10 to facilitate the registration of the coaxial cable assembly therein, again as discussed below. As is indicated particularly in FIG. 6, opening 20 in base exterior surface 20 is stepped-down depthwise of housing 10 to define a contact-receiving passage 40. Passage 40 extends transversely in housing 10 into and somewhat beyond drain wire passage 34 and insulated center conductor passage 32. Drain wire passage 34 and opening 18 extend fully longitudinally with side wall 16 of housing 10, terminating openly in rear wall 42.

Figure 2:
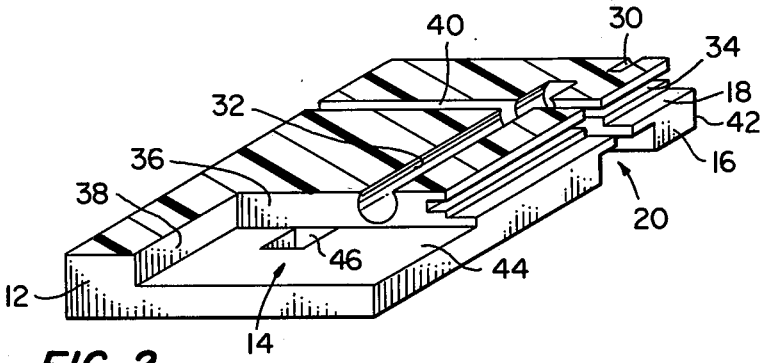
FIG. 2 is a sectional perspective view of the FIG. 1 housing as seen downwardly of plane II—II of FIG. 3.
Figure 4:
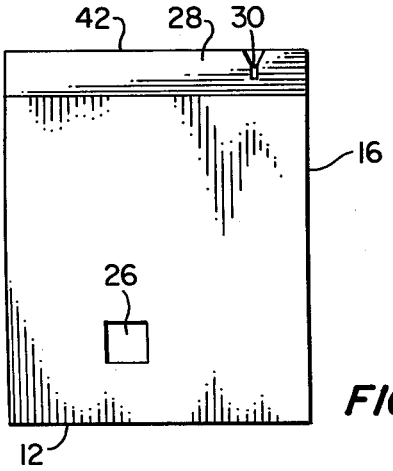
FIG. 4 is a plan elevation of the FIG. 1 housing.
Figure 5:
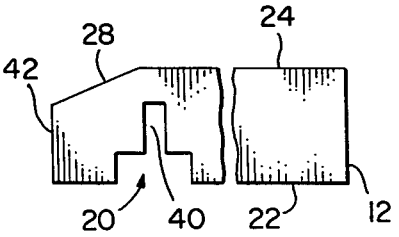
FIGS. 5 and 6 are respective left and right side elevations of the FIG. 1 housing.
Figure 3:
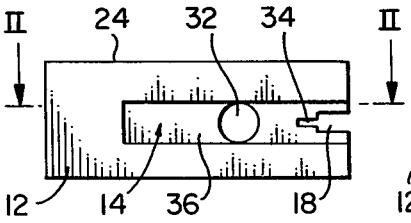
FIG. 3 is a front elevation of the FIG. 1 housing.
Figure 6:
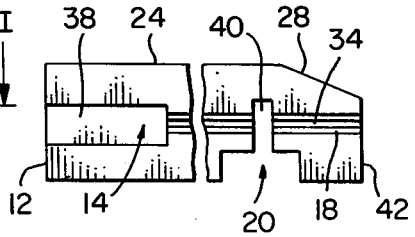

In the perspective section shown in FIG. 2, housing 10 has the upward portion thereof removed, i.e., the view indicates a section in perspective downwardly of plane II—II of FIG. 3. As will be seen in FIG. 2, contact-receiving channel 40 extends fully laterally of housing 10 and passage 32 extends depthwise into the housing beyond passage 40. Drain wire retention channel 30 extends depthwise from rear wall 42 to a location spaced depthwise from passage 40. Inlet passage 14 will be seen as being bounded by cable assembly seat 44, which defines opening 46 vertically in registry with opening 26 (FIG. 1) and extending downwardly to be accessible exteriorly of base exterior surface 22.

Figure 7:
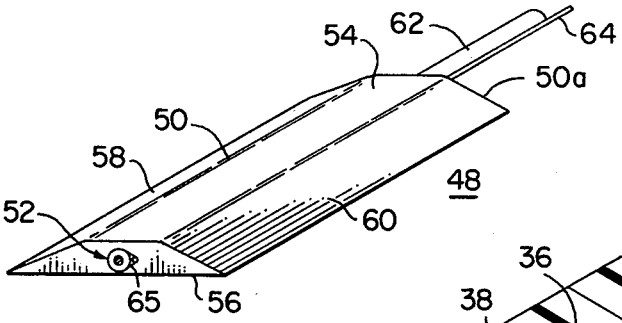
FIG. 7 is a perspective view of a cable assembly for termination by connectors of the invention.

FIG. 7 illustrates the above-discussed cable assembly which is the subject of applicant's copending and commonly-assigned application. Such assembly 48 comprises a resilient body 50, preferably of electrically insulative protective material circumscribing cable subassembly 52, which extends longitudinally through and beyond body 50. Body 50 is of general trapezoidal outline, defining ceiling 54, base 56 and side walls 58 and 60 tapering outwardly downwardly of ceiling 54 to base 56. Insulation 62 is annularly arranged with respect to a central conductor of cable subassembly 52 and drain wire 64 is in contiguous disposition in body 50 with electrically conductive sheath 65, which circumscribes both insulation 62 and drain wire 64. As is discussed more fully in such copending patent application, cable subassembly 52 is disposed vertically adjacent base 56, the body 50 defining a thin film between base 56 and cable subassembly 52 which facilitates release of the cable by stripping through base 56. In the FIG. 7 showing of cable assembly 48, insulated conductor 62 and drain wire 64 have been stripped from body 50 and both the body 50 and sheath 65 have been removed from the assembly defining new front edge **50*a* for body 50**.

Figure 8:
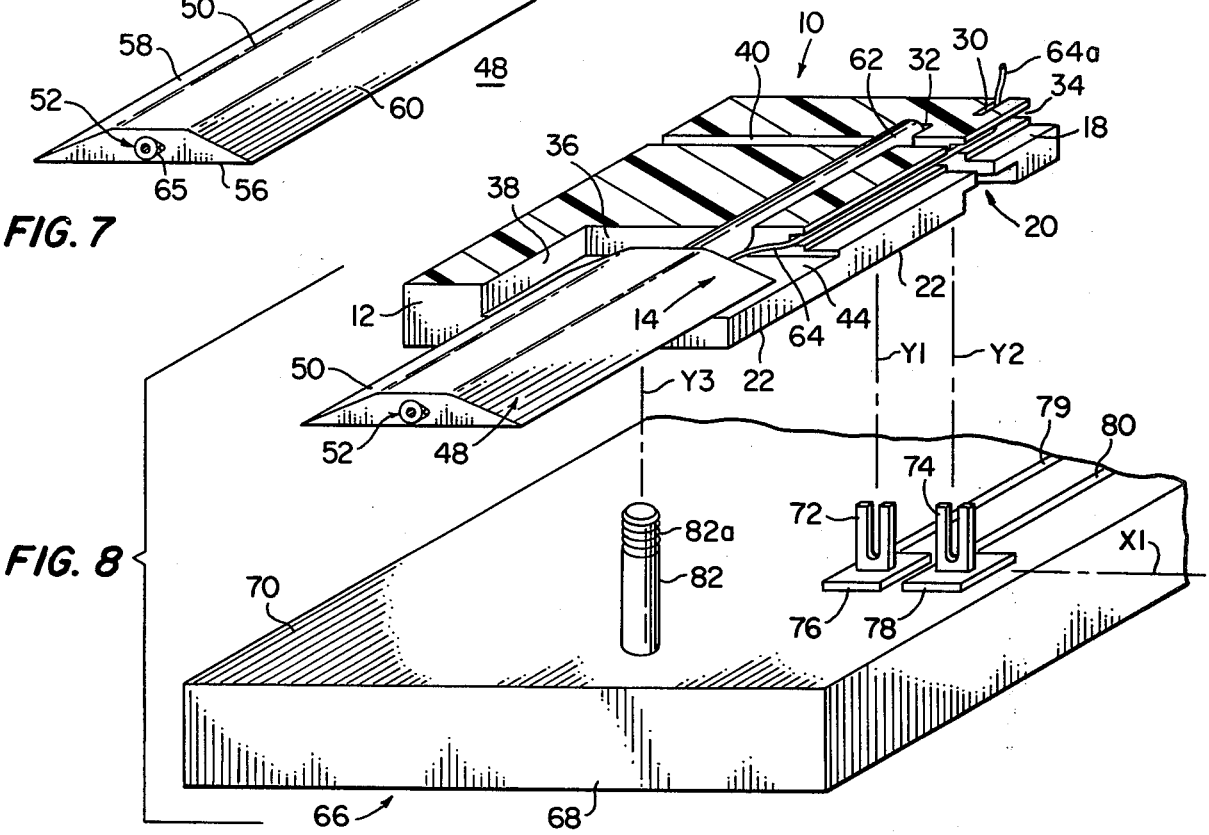
FIG. 8 is an exploded perspective view of the housing of FIG. 1, with a portion removed, supporting the cable assembly of FIG. 7, and a lower connector housing in accordance with the invention.

With cable assembly 48 prepared as indicated in FIG. 7, the cable is introduced into upper connector housing 10 in manner indicated in the upper portion of FIG. 8 wherein the housing is again shown in the perspective sectional view as in FIG. 2. Cable assembly 48 is moved depthwise into inlet passage 14, side wall 38 providing a general guide for the leftward side edge of assembly 48. Insulated conductor 62 is moved into guide passage 32 in the course of entry of assembly 48 into housing 10 and the length of the conductor is preselected such that the conductor spans contact passage 40. Drain wire 64 is grasped at end **64*a* and withdrawn laterally from the housing to then be inserted in opening 18 and into drain wire guide passage 34. The drain wire is pulled taut and end 64*a* is disposed vertically to enter drain wire retention channel 30 and is then pulled toward front wall 12 to be tightly grasped by the side walls of channel 30**.

Lower connector housing 66 in FIG. 8 has front wall 68 and exterior surface 70 upon which are disposed a pair of contacts 72 and 74, each of which is adapted to make gas-tight electrical connection with its associated conductor in housing 10. Contact 72 is of course of insulation-piercing variety and is aligned along vertical axis Y1, contact 74 being aligned along vertical axis Y2. Electrically insulative pedestals 76 and 78 respectively support contacts 72 and 74 and are configured complemental to the outline of opening 20 into contact passage 40 of housing 10. Exterior 70 of housing 66 may constitute a surface of a PCB upon which conductive traces or strips 79 and 80 may be electrically connected respectively to contacts 72 and 74. A post member 82 extends outwardly of exterior surface 70, being aligned along vertical axis Y3. The depthwise spacing between post member 82 and contacts 72 and 74 (both of which are disposed along the same lateral axis X1) is the same as the depthwise spacing between opening 46 (FIG. 2) of housing 10 and contact passage 40. As will now be evident, post member 82 comprises a housing interlock means, together with a suitable interiorly threaded member (nut 84 of FIG. 10). Post member 82 thus has vertical extent exceeding the vertical expanse through hole 46, inlet passage 14 and hole 26 of housing 10 and disposes its exteriorly threaded surface **82*a* within and upwardly of housing 10 upon joinder of housings 10 and 66 along exterior surfaces 22 and 70** thereof.

In the course of the single mechanical input attending securement of housings 10 and 66, i.e., the tightening of nut 84 upon post member 82, contacts 72 and 74 are drawn into gas-tight electrical connection with conductor 62 through the insulation thereof and drain wire 64, which is bare. Further, since housing 10 (FIG. 1) defines cantilever-supported extents bordering inlet passage 14, beneath ceiling 24 and base 22, in which area both holes 26 and 46 (FIG. 2) are located, the tightening of nut 84 upon post member 82 gives rise to a deflection of such cantilever-supported and displaceable extents of housing 10 onto that portion of cable assembly 48 resident in inlet passage 14, affording strain-relieving force to body 50.

Alternatively considered, openings 26 and 46 (FIGS. 1 and 2) define with inlet passage 14 area therebetween an interconnect passage extending transversely through the first housing in communication with the cable-receiving passage and in preselected longitudinal spacing from contact passage 40. The passage comprises, together with post member 82, composite keying and joinder securement means for the connector of FIGS. 1–8. Additionally, the structure described provides a polarization for cable assembly 48 and the connector, since post member 82 and contact 72 are laterally displaced on surface 70. As is discussed below, contact 74 may be dispensed with and the assembly may comprise contact 72 alone with post member 82 where it is desired to terminate insulated conductor 62 through connection in contact passage 40 and otherwise terminate drain wire 64. In the preferred embodiment being discussed, however, both contacts 72 and 74 are present and the polarization scheme extends to the fact that post member 82 and contact 74 are disposed in laterally opposite directions of contact 72.

Figure 9:
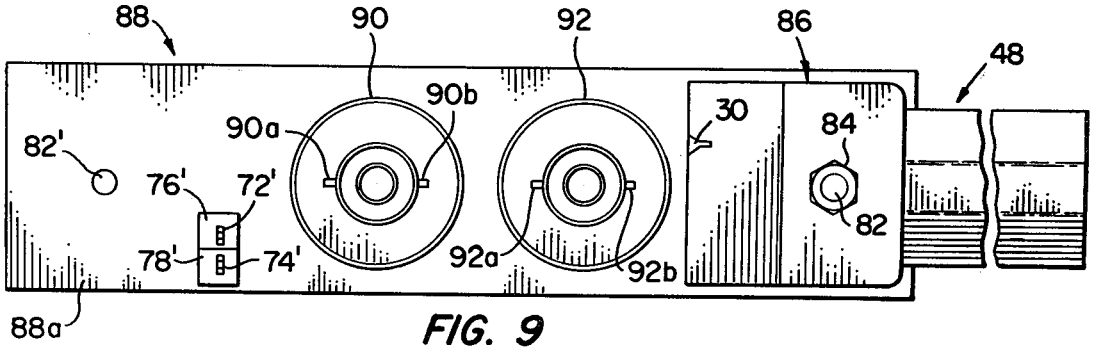
FIG. 9 is a schematic plan view of the connector of FIG. 8, assembled with the cable assembly of FIG. 7, disposed on a printed circuit board (PCB) also supporting commercially-known coaxial connectors for transition from the FIG. 7 cable assembly to larger coaxial cables.
Figure 10:
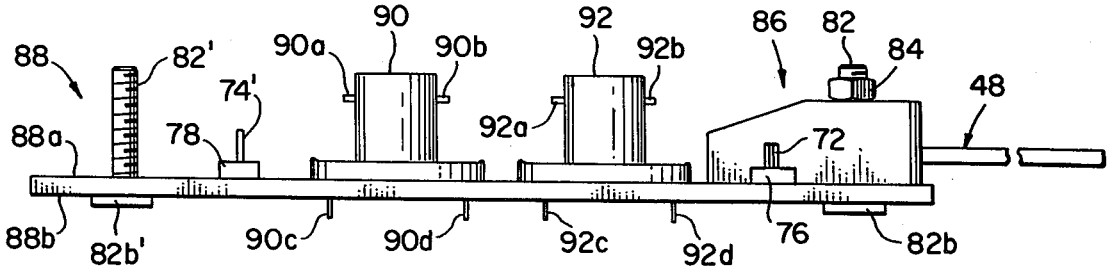
FIG. 10 is a schematic front elevation of the FIG. 9 apparatus.

In FIGS. 9 and 10, reference numeral 86 identifies the connector discussed to this juncture in position on PCB 88 and terminating cable assembly 48. Board 88 provides a transition from the quite low height profile cable assembly 48, suited for undercarpet usage, and larger coaxial cable of commercially available variety to which connections can be made by BNC connectors 90 and 92, also of commercially available variety. Connectors 90 and 92 include respective detents 90*a*, 90*b* and 92*a*, 92*b* for retaining complemental connectors (not shown) which terminate the larger coaxial cable. The connectors also include downwardly depending contact legs 90*c*, 90*d* and 92*c*, 92*d*. In the embodiment of FIGS. 9 and 10, transition capability extends rightwardly and leftwardly on the board. Thus, connector 90 has its signal and ground contacts electrically connected, by board strips discussed in connection with FIGS. 11 and 12 below, to contacts 72' and 74', supported on pedestals 76' and 78'. Post member 82' extends through upper surface 88*a* of the PCB and has an expanded diameter base 82*b'* which is flush against the undersurface 88*b* of the board. For clarity, the connector housings which would be interlocked by post member 82' are omitted. Connector 92 has its signal and ground contacts in electrical connection with the interior contacts of connector 86. The separate housings of connector 86 are interlocked by post member 82 and nut 84, the expanded diameter portion 82*b* of post 82 also being flush against the undersurface 88*b* of the PCB.

Figure 11:
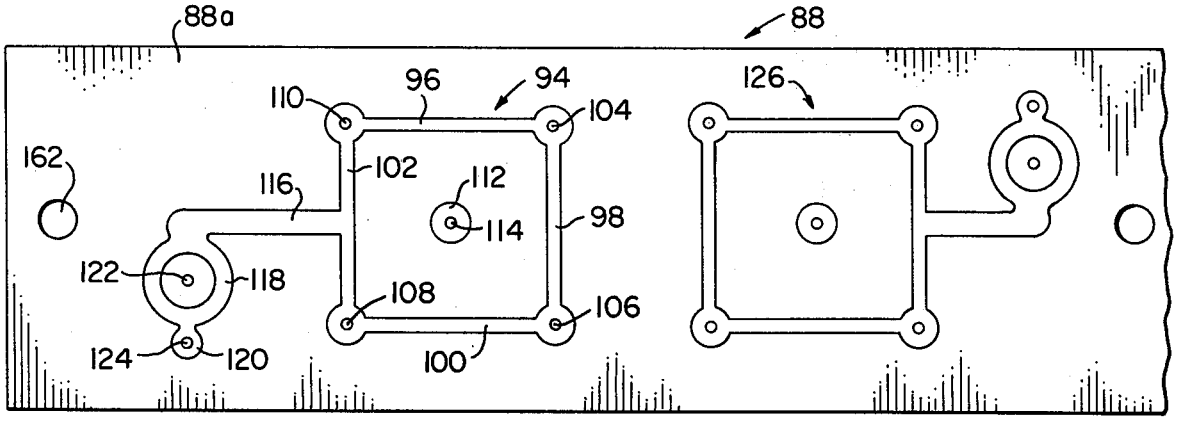
FIG. 11 is an upperside view of the PCB of FIG. 9, with components removed.
Figure 12:
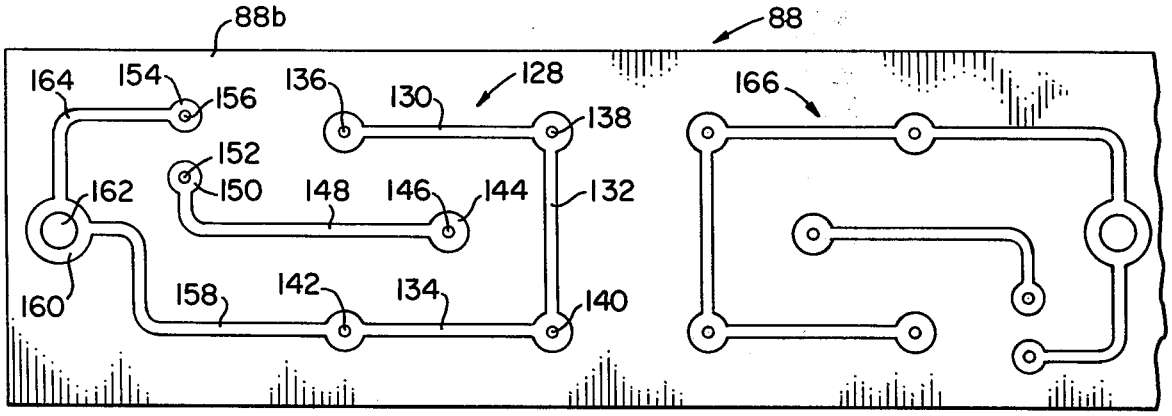
FIG. 12 is an underside view of the PCB of FIG. 9.

FIGS. 11 and 12 indicate respectively the upper side 88*a* and the lower side 88*b* of PCB 86, with components removed for clarity. Leftwardly in FIG. 11, surface 88*a* supports a conductive strip arrangement 94 having a predominant rectangular configuration bounded by strips 96, 98, 100 and 102. Openings 104–110 extend entirely through PCB 88 in registry with the pads at the four corners of strip arrangement 94, to permit electrical connection with the legs of connector 90. Thus, on mounting connector 90 on the PCB, legs 90*c* and 90*d* would enter openings 108 and 106, to then be soldered to strip arrangement 94. Centrally of the open rectangle, conductive pad 112 has opening 114 for receiving the signal contact of connector 90. Proceeding leftwardly, strip arrangement 94 includes strip 116 extending electrically continuously with strip 102 and extending to enlarged circular strip 118 and then to pad 120. Opening 122 is formed centrally in circular strip 118 and receives contact 72' (FIG. 9), which remains electrically free of circular strip 118. Conversely, opening 124 receives contact 74', which is electrically continuous with pad 120. Upon drain wire connection to contact 74', the entirety of strip arrangement 94 will be placed at ground potential. Rightwardly of strip arrangement 94, board 88 includes an identically configured, but 180-degree-rotated conductive strip arrangement 126 which electrically interconnects the signal and ground contacts of connector 92 respectively with insulation-piercing contact 72 of connector 86 (FIG. 10) and the drain wire contact thereof.

Referring to FIG. 12, undersurface 88*b* of PCB 88 supports a conductive strip arrangement 128 which includes an open rectangular portion defined by strips 130, 132 and 134, pads of which have holes 136, 138, 140 and 142 extending entirely through the PCB. Upon assembly of connector 92 with the PCB, its legs will extend also through holes 136–142, legs 90*c* and 90*d* registering respectively with holes 136 and 138. Centrally of the open rectangle lies pad 144, having hole 146 therethrough for receipt of the signal contact of connector 90. Strip 148 extends leftwardly to pad 150, having hole 152. Upwardly of pad 150 is pad 154, having hole 156. Contact 74' (FIG. 9) will be seated in hole 152 for electrical connection through pad 150 and strip 148 to pad 144 and hence the signal contact of connector 90. Strip 158 is continuous with strip 134 and with pad 160, the central opening 162 of which permits passage of post member 82'. Strip 164 interconnects pads 154 and 160. By this arrangement, electrical ground may be derived through pad 154 from contact 74' and conveyed to the entirety of strip arrangement 128, except for signal strip 148 and its pads 144 and 150. Alternatively, where the drain wire is in electrical contact with post member 82', strip 164 and pad 154 may be omitted, since electrical ground is now furnished to strip arrangement 128 through electrical engagement of post member base 82*b'* and pad 160. Even in such latter event, pad 154 and strip 164 may be present to provide for redundant ground connection. Rightwardly of strip arrangement 128, board undersurface 88*b* includes strip arrangement 166, again conforming to strip arrangement 128, except for the 180-degree reversal in position of the pads disposed beneath the contacts of connector 86.

Figure 13:
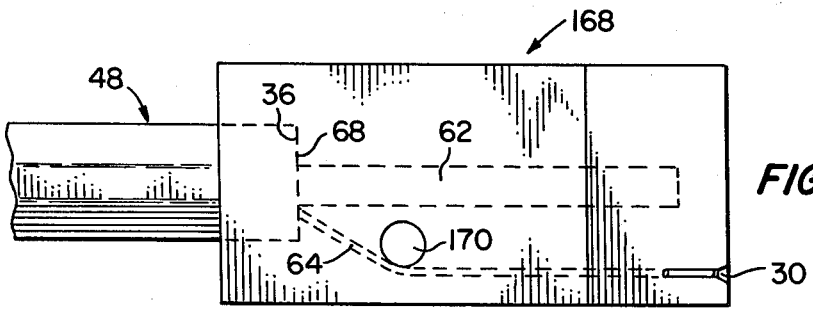
FIG. 13 is a schematic plan view of a second embodiment of a connector in accordance with the invention.

Turning now to FIG. 13, connector 168 is shown schematically in plan elevation and is configured likewise with the connector of FIGS. 1–8, except for a change in the disposition of the post element providing housing interconnect. Here, post element 170 is displaced from its passage above, i.e., through inlet seating surface 44 (FIG. 8), and is disposed depthwise further within the connector housings. In this arrangement, cable assembly front end 68 directly abuts upper housing surface 36, i.e., cable assembly 48 resides fully depthwise within the inlet passage. Drain wire 64 has its guide passage in communication with the periphery of post element 170 and the drain wire is routed against the post, again tautly stretched by disposition of its end in contact retention channel 30, whereby electrical continuity exists as between drain wire 64 and post element 170. Referring back to FIG. 12, the disposition of pad 160 and opening 162 is modified, such that an expanded base portion of post element 170 abuts against pad 160 to carry the drain wire electrical continuity through to strip arrangement 128.

Figure 14:
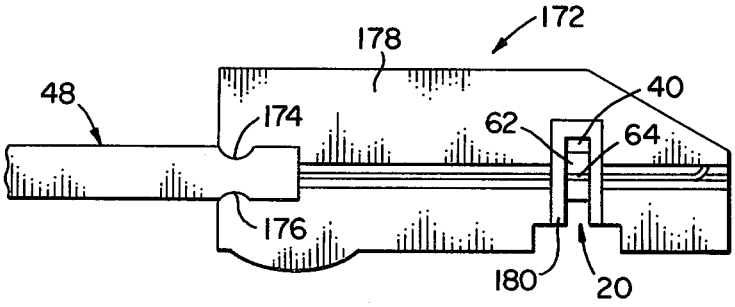
FIG. 14 is a schematic side elevation of a third embodiment of a connector in accordance with the invention.

In FIG. 14, a still further embodiment of connector in accordance with the invention is shown. Here, connector 172 includes dimpled surfaces 174 and 176 vertically bounding the cable inlet or receiving passage. Housing 178 of connector 172 may be comprised of metal, as opposed to the foregoing electrically insulative compositions for the upper and lower housings. In this instance, an insert 180 comprised of electrically insulative material is disposed in contact-receiving passage 40 to electrically isolate the insulation-piercing and drain wire contact from electrical engagement with housing 178. As is further to be appreciated, housing 178 may be maintained at electrical ground, for example, by use of the post element grounding feature discussed immediately above in connection with FIGS. 13 and 12. In this instance, the post element would carry electrical ground through its associated nut to the metallic housing.

In the foregoing embodiment, the upper connector housing is a molded body having the several passages bounded by integral plastic. The invention contemplates alternative construction wherein the upper connector housing may be formed in mating half sections joined by a hinge formed integrally therewith and defining rear housing wall 42. Thus, the sections may have confronting surfaces, which mate upon bending of the sections about the hinge, together to define the interior structure, e.g., guide passages, of the upper connector housing. As will be appreciated, the drain wire passage may be closed sidewardly of such alternate housing as the drain wire and insulated center conductor may be placed in the housing prior to bending of the sections from open to closed positions. Additional strain relief may also be provided in such alternate housing as the passages may be placed in gripping relation to the insulated conductor, as contrasted with the illustrated integral housing embodiments wherein the passages are larger than the members having guided movement therein.

Various changes to and modifications of the foregoing particularly described embodiments of connectors in accordance with the invention will now be evident to those skilled in the art. The particularly disclosed and described embodiments are thus intended in an illustrative and not in a limiting sense. The true spirit and scope of the invention is set forth in the appended claims.

What is claimed is:

1. An electrical connector for terminating an electrical cable assembly of type having a protective body and an electrically insulated conductor extending through and beyond said body, said connector comprising:

(a) a first housing for supporting said body and such extending insulated conductor, said first housing defining an inlet passage for receiving said body and a guide passage communicating with said inlet passage for receiving said insulated conductor, said first housing defining a contact-receiving passage accessible exteriorly of said first housing and extending transversely therein into such conductor-receiving passage;

(b) a second housing joinable to said first housing and having an exterior surface supporting an insulation-piercing contact; and (c) housing interconnect means for joinder of said first and second housings and operably responsive to mechanical input for both applying strain-relieving force to said body and forcing said contact into electrical engagement with said conductor through said contact-receiving passage.

2. The electrical connector claimed in claim 1 wherein said first housing is elongate and defines a longitudinally extending, transversely stepped passage therein for receiving said cable assembly.

3. The connector claimed in claim 1 wherein said first housing further defines an interconnect passage extending transversely therethrough in communication with said body-receiving passage and in preselected longitudinal spacing from said contact-receiving passage.

4. The connector claimed in claim 3 wherein said second housing supports said housing interconnect means on said exterior surface of said second housing longitudinally spaced from said contact by said preselected spacing.

5. The connector claimed in claim 4 wheren said housing interconnect means comprises a post member extending transversely of said second housing a distance in excess of the transverse extent of said interconnect passage.

6. The connector claimed in claim 5 wherein said post member is exteriorly threaded, said housing interconnect means further comprising an interiorly threaded member movable on said post member to secure said first housing to said second housing.

7. The connector claimed in claim 6 wherein said first housing includes a portion which is displaceable into strain-relieving engagement with said body upon such movement of said interiorly threaded member on said post member.

8. The connector claimed in claim 7 wherein said post member and said contact are mutually laterally spaced on said exterior surface of said second housing.

9. An electrical connector for termination of a coaxial cable assembly of type having a resilient protective body and both an electrically insulated conductor and a drain wire extending through and beyond said body, said connector comprising: first and second joinable housings, said first housing defining an inlet passage for receiving said body, first and second guide passages both continuous with said inlet passage respectively for receiving said conductor and said drain wire, and a contact-receiving passage accessible through an exterior surface of said first housing and extending into both said first and second guide passages, said second housing having an exterior surface having configuration complemental to said exterior surface of said first housing and supporting an insulation-piercing contact and a further contact in disposition for entry into said contact-receiving passage on joinder of said first and second housings along said exterior surfaces thereof, and housing interconnect means providing for registry of said insulation-piercing contact and said further contact respectively with said first and second guide passages and in said contact-receiving passage.

10. The connector claimed in claim 9 wherein said second guide passage is accessible exteriorly of said first housing throughout the extent of said second guide passage.

11. The connector claimed in claim 9 wherein said first housing defines a channel accessible exteriorly of said first housing and in communication with said second guide passage, said channel being configured for receiving and retaining an end of said drain wire.

12. The connector claimed in claim 9 wherein said housing interconnect means is electrically conductive, said second guide passage extending openly to said housing interconnect means to dispose said drain wire electrically continuous therewith.

13. The electrical connector claimed in claim 9 wherein said first housing is elongate and defines a longitudinally extending, transversely stepped passage therein for receiving said cable assembly.

14. The connector claimed in claim 13 wherein said first housing defines a contact-receiving passage accessible exteriorly of said first housing and extending transversely therein into both said first and second guide passages.

15. The connector claimed in claim 14 wherein said first housing defines an interconnect passage extending transversely therethrough in communication with both said first and second guide passages and in preselected longitudinal spacing from said contact-receiving passage.

16. The connector claimed in claim 15 wherein said second housing supports said housing interconnect means on said exterior surface of said second housing longitudinally spaced from both said insulation-piercing and said further contact by said preselected spacing.

17. The connector claimed in claim 16 wherein said housing interconnect means comprises a post member extending transversely of said second housing a distance in excess of the transverse extent of said interconnect passage.

18. The connector claimed in claim 17 wherein said post member is exteriorly threaded, said housing interconnect means further comprising an interiorly threaded member movable on said post member to secure said first housing to said second housing.

19. The connector claimed in claim 18 wherein said first housing includes a portion which is displaceable into strain-relieving engagement with said body upon such movement of said interiorly threaded member on said post member.

20. The connector claimed in claim 19 wherein said post member and said further contact are spaced in opposite directions laterally of said insulation-piercing contact.

21. An electrical connector for insulation-piercing termination of a coaxial cable assembly of type having a protective body and an electrically insulated conductor extending through and beyond said body, said connector comprising:

(a) a first housing defining an inlet passage for receiving said body, a guide passage continuous with said inlet passage for receiving said insulated conductor, and a contact-receiving passage accessible through an exterior surface of said first housing and extending into said guide passage;

(b) a second housing having an exterior surface of configuration for interfitting with said first housing exterior surface and supporting an insulation-piercing contact in disposition for entry into said contact-receiving passage; and (c) housing interconnect means for providing registry of said contact and said contact-receiving passage and operable to force said contact into electrical engagement with said conductor.

22. The connector claimed in claim 21 wherein said housing interconnect means is further operable to force at least one of said housings into strain-relieving engagement with said body.

23. The connector claimed in claim 22 wherein said housing interconnect means is responsive to single mechanical input for both such forcing of said contact into such electrical engagement with said conductor and such forcing of at least one of said housings into such strain-relieving engagement with said body.

24. The electrical connector claimed in claim 21 wherein said first housing is elongate, said inlet passage and said guide passage being longitudinally extending and mutually transversely stepped.

25. The connector claimed in claim 24 wherein said first housing further defines an interconnect passage extending transversely therethrough in communication with said inlet passage and in preselected longitudinal spacing from said contact-receiving passage.

26. The connector claimed in claim 25 wherein said second housing supports said housing interconnect means on said exterior surface of said second housing longitudinally spaced from said contact by said preselected spacing.

27. The connector claimed in claim 26 wherein said housing interconnect means comprises a post member extending transversely of said second housing a distance in excess of the transverse extent of said inteconnect passage.

28. The connector claimed in claim 27 wherein said post member is exteriorly threaded, said housing interconnect means further comprising an interiorly threaded member movable on said post member to secure said first housing to said second housing.

29. The connector claimed in claim 28 wherein said first housing includes a portion which is displaceable into strain-relieving engagement with said body upon such movement of said interiorly threaded member on said post member.

30. The connector claimed in claim 29 wherein said post member and said contact are mutually laterally spaced on said exterior surface of said second housing.

* * * * *

Disclaimer 4,403,820.—*Donald S. Rich,* Long Valley, N.J. CONNECTOR FOR TERMINATING UNDERCARPET SIGNAL TRANSMISSION CABLE. Patent dated Sept. 13, 1983. Disclaimer filed Nov. 30, 1983, by the assignee, *Thomas & Betts Corp.*

Hereby enters this disclaimer to claims 9 and 21 of said patent.

[*Official Gazette January 31, 1984.*]